United States Patent [19]

Post et al.

[11] Patent Number: 4,460,884

[45] Date of Patent: Jul. 17, 1984

[54] TRANSFORMER COMPRISING A MAGNETIC SCREEN

[75] Inventors: Sieghard Post, Guntersdorf; Siegfried Mehl, Hamburg, both of Fed. Rep. of Germany

[73] Assignee: U.S. Philips Corporation, New York, N.Y.

[21] Appl. No.: 392,046

[22] Filed: Jun. 25, 1982

[30] Foreign Application Priority Data

Jul. 4, 1981 [DE] Fed. Rep. of Germany ..... 3126498

[51] Int. Cl.[3] ..... H01F 27/28

[52] U.S. Cl. ..... 336/73; 336/84 M; 336/84 R; 336/84 C; 336/77; 336/100

[58] Field of Search ..... 336/73, 84 M, 84 R, 336/84 C, 77, 100

[56] References Cited

U.S. PATENT DOCUMENTS 3,626,345 12/1971 Funaki ..... 336/84 M

FOREIGN PATENT DOCUMENTS 54-119621 9/1979 Japan ..... 336/84 C

*Primary Examiner*—J. V. Truhe
*Assistant Examiner*—Susan Steward
*Attorney, Agent, or Firm*—Robert T. Mayer; Bernard Franzblau

[57] ABSTRACT

A transformer including a lamination core of band iron and a magnetic screen which consists of a wound iron band arranged around the lamination core (5) and which is secured to the core by means of expansion wedges provided in the space between the core and the screen 13. The expansion wedges (7) extend transversely of or at an angle with respect to the winding direction of the wound iron band.

13 Claims, 5 Drawing Figures

TRANSFORMER COMPRISING A MAGNETIC SCREEN

BACKGROUND OF THE INVENTION

The invention relates to a transformer comprising a lamination core of band iron and a magnetic screen which consists of a wound band which is arranged around the lamination core and which is secured to the core.

Magnetic screens of this kind are known. The screens are wound in several layers of permeable band iron. After winding, they are slid over the core of the transformer and are secured thereto. This is realized by filling the space between the core and the wound band with a moulding compound. This filling operation is a comparatively expensive manufacturing step.

It is an object of the invention to provide a magnetic screen for transformers which is simple but fully effective.

SUMMARY OF THE INVENTION

The object in accordance with the invention is achieved by providing expansion wedges in the space between the core and the screen. The expansion wedges extend transversely of or at an angle with respect to the winding direction of the band.

A screen of this kind is suitably secured to the core and does not come loose or cause hum.

In an embodiment in accordance with the invention, the expansion wedges are made of a permanently tough plastic material. Fitting is facilitated when plastic expansion wedges form a part of a band of permanently tough plastics. In that case it is not necessary to provide the expansion wedges separately.

The screen is substantially improved when a copper shortcircuit ring is arranged around the transformer underneath the plastics band, the axis of said shortcircuit ring extending transversely of the axis of the ring-shaped screen.

BRIEF DESCRIPTION OF THE DRAWING

An embodiment in accordance with the invention will be described in detail hereinafter with reference to the drawing.

DESCRIPTION OF THE PREFERRED EMBODIMENTS

Figure 1:
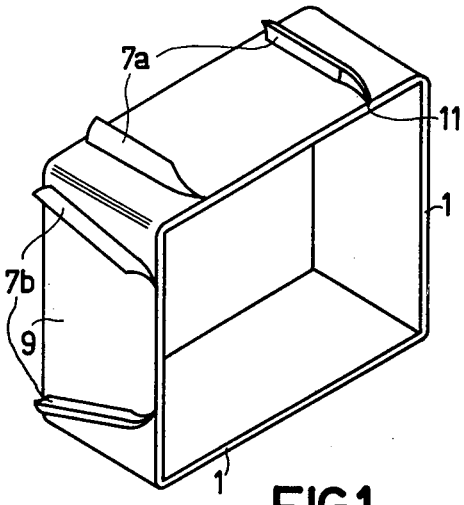
FIG. 1 shows a closed plastic ring band with tail-like expansion wedges for fixation of the screen.
Figure 2:
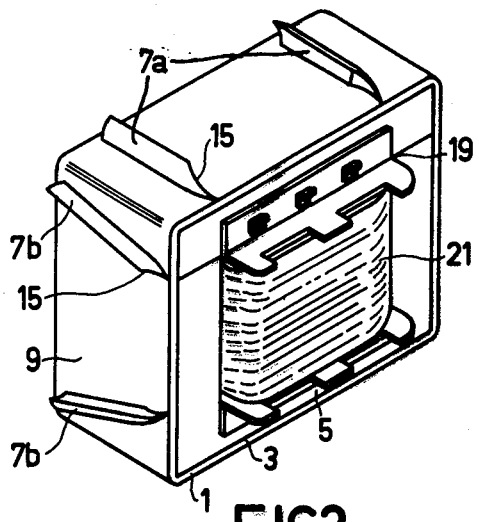
FIG. 2 shows the plastic ring band of FIG. 1 slid around a transformer.
Figure 3:
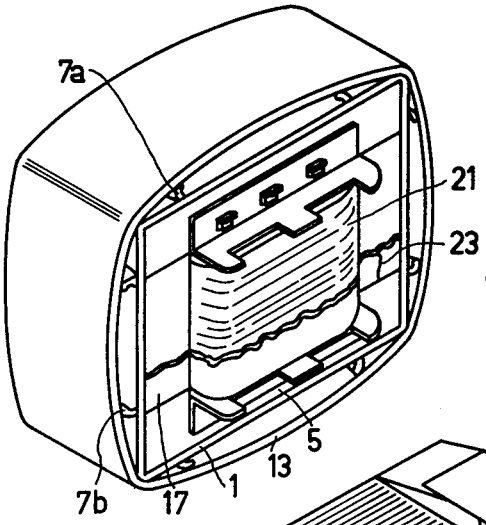
FIG. 3 shows the transformer with the fitted plastic ring band according to FIG. 2 and a screen slid thereover.

FIG. 1 shows a ring-shaped plastic band 1 which is made of a tough, elastic, aging-resistant and temperature-resistant plastic. The length of the ring band 1 is such that it can be pulled over the outer surface 3 of the iron core 5 of a transformer (FIG. 2). On the ring band there are provided tail-shaped expansion wedges *7a* which extend transversely of the longitudinal direction of the band and tail-shaped expansion wedges *7b* which extend at an angle with respect to the longitudinal direction of the band. Other shapes of the expansion wedges are also feasible, for example, a triangular shape. The expansion wedges project from the outer surface 9 of the ring-shaped plastic band 1. The base 11 of the expansion wedges *7a* and *7b* is manufactured to be integral with the plastic band 1, FIG. 3 shows how a ring-shaped screen 13 is pulled over the plastic band 1. The ring-shaped screen 13 consists of a wound permeable iron band. This screen is wound to the desired number of layers in advance and is interconnected by spot welding, followed by annealing and vacuum impregnation.

The front ends 15 of the expansion wedges *7a* and *7b* are bevelled in order to facilitate the sliding on of the screen 13. During the sliding on of the screen 13, the expansion wedges *7a* and *7b* are deformed. Due to the stress thus produced, the expansion wedges *7a* and *7b* clamp the screen 13 so that a durable connection is established.

The screen 13 may be supplemented by a copper short-circuit ring 17 which is arranged around the transformer 19 across the full width of the copper winding 21. In FIG. 3, the copper shortcircuit ring is shown only over a part of the copper winding 21 for the sake of clarity. The copper shortcircuit ring 17 may be closed by means of a welded joint 23.

Figure 4:
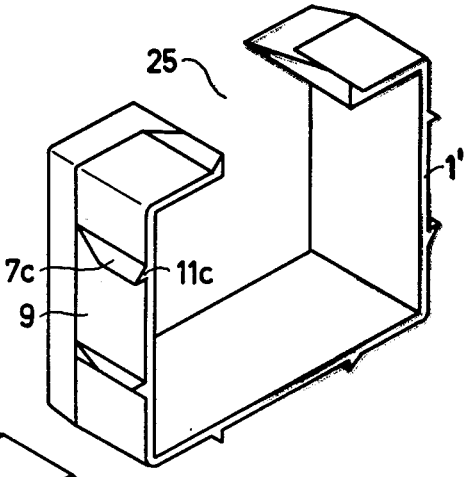
FIG. 4 shows an open plastic ring band with ramp-like expansion wedges.

The plastic ring 1 need not be closed over the full length of the ring. FIG. 4 shows an embodiment in which the plastic band 1' comprises a wide gap 25 at its top. The expansion wedges *7c* have a ramp-like shape. The bases 11*c* of the expansion wedges *7c* are integral with the material of the plastic band 1'.

Figure 5:
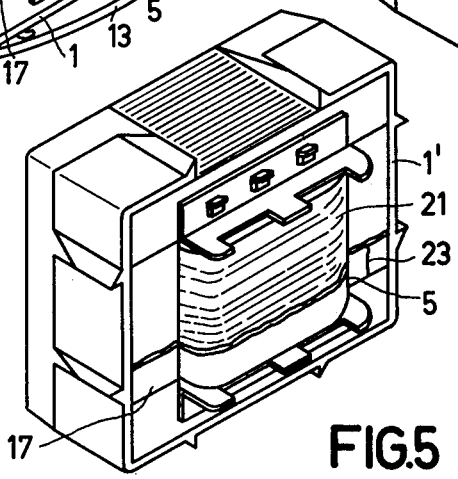
FIG. 5 shows a transformer with a surrounding open plastic ring band as shown in FIG. 4.

In FIG. 5, the transformer core 5 has been slid into the plastic band 1'. A copper shortcircuit ring 17 may again be arranged around the coil 21, said shortcircuit ring being closed by means of a welded joint 23.

In addition to the ramp-like shape, of course, a triangular shape and other suitable shapes are feasible for the expansion wedges.

On the plastic band 1' shown in the FIGS. 4 and 5, again consisting of an aging-resistant, tough plastic, a screen of wound permeable iron band is slid during final assembly.

FIGS. 3 and 5 clearly show that the axes of the ring-shaped screen 13 and the copper shortcircuit ring 17 extend perpendicularly with respect to one another.

What is claimed is

1. A transformer comprising a lamination core of band iron, and a magnetic screen comprising a wound band arranged around the lamination core with a space therebetween and secured to the core by means of expansion wedges provided in the space between the lamination core and the magnetic screen, wherein said expansion wedges extend transversely of or at an angle with respect to the winding direction of the wound band.

2. A transformer as claimed in claim 1, wherein the expansion wedges are made of a permanently tough plastic material.

3. A transformer as claimed in claim 1, wherein the expansion wedges form part of a band made of a permanently tough plastic material.

4. A transformer as claimed in claim 3 further comprising, a copper shortcircuit ring arranged around the transformer and underneath the plastic band, the axis of said shortcircuit ring extending perpendicularly to the axis of the wound band magnetic screen.

5. A transformer as claimed in claim 1, further comprising a copper shortcircuit ring arranged around the transformer and having an axis extending perpendicular to the axis of the wound band magnetic screen.

6. A transformer comprising, an iron lamination core, a copper winding wound on said iron core, a magnetic screen comprising a band of magnetic material arranged around the iron core to provide a space therebetween, and means for securing the magnetic screen to the iron core including a plurality of expansion wedges located in said space between the magnetic screen and the iron lamination core and which extend at an angle with respect to the magnetic screen.

7. A transformer as claimed in claim 6 wherein said securing means comprises a ring-shaped band of plastic material within said space and said expansion wedges extend from the outer surface thereof and are integral with and form a part of said plastic ring-shaped band.

8. A transformer as claimed in claim 7 wherein the expansion wedges have a ramp-like shape or a triangular shape.

9. A transformer as claimed in claim 7 wherein the magnetic screen comprises a wound band of permeable iron and said expansion wedges are tail-shaped and extend transversely to the longitudinal direction of the wound band.

10. A transformer as claimed in claim 6 wherein the magnetic screen comprises a wound band of permeable iron and said expansion wedges are made of a plastic material and are tail-shaped and extend transversely of or at an angle with respect to the winding direction of the wound iron band.

11. A transformer as claimed in claim 7 further comprising an electrically conductive short-circuit ring surrounding the iron lamination core and located inside of the ring-shaped plastic band, said short-circuit ring having an axis that extends perpendicular to an axis of the magnetic screen.

12. A transformer as claimed in claim 7 further comprising an electrically conductive short-circuit ring surrounding the iron lamination core and located inside of the ring-shaped plastic band, said short-circuit ring having an axis that extends perpendicular to the axis of the ring-shaped plastic band.

13. A transformer as claimed in claim 6, wherein the magnetic screen comprises a wound band of permeable iron and the securing means comprises a ring-shaped band of plastic material within said space and wherein said expansion wedges extend from the outer surface thereof and are integral with and form a part of said ring-shaped plastic band, and a copper short-circuit ring surrounding the iron lamination core and located inside of the ring-shaped plastic band, said short-circuit ring having an axis that extends perpendicular to the axis of the wound band magnetic screen.

* * * * *